US005441077A

United States Patent [19]

Smith et al.

[11] Patent Number: 5,441,077

[45] Date of Patent: Aug. 15, 1995

[54] FEEDBACK AIR PRESSURE SENSING SYSTEM

[75] Inventors: Rowland C. Smith, Wimborne; Paul L. Garlick, Poole, both of United Kingdom

[73] Assignee: ITW Limited, Windsor, United Kingdom

[21] Appl. No.: 256,159

[22] PCT Filed: Jan. 12, 1993

[86] PCT No.: PCT/GB93/00058

§ 371 Date: Jun. 23, 1994

§ 102(e) Date: Jun. 23, 1994

[87] PCT Pub. No.: WO93/13870

PCT Pub. Date: Jul. 22, 1993

[30] Foreign Application Priority Data

Jan. 13, 1992 [GB] United Kingdom ..... 9200585
Jan. 13, 1992 [GB] United Kingdom ..... 9200630

[51] Int. Cl.[6] ..... B05B 7/08; B05B 7/12

[52] U.S. Cl. ..... 137/492.5; 239/126

[58] Field of Search ..... 137/488, 492, 492.5; 239/126

[56] References Cited

U.S. PATENT DOCUMENTS 1,361,271 12/1920 Neal ..... 137/492.5
1,843,953 2/1932 McKinney ..... 137/492.5
2,583,006 1/1952 Niesemann ..... 137/492.5 X
2,736,337 2/1956 Parks ..... 137/492.5

FOREIGN PATENT DOCUMENTS 0064048 11/1982 European Pat. Off. .
0188024 7/1986 European Pat. Off. .
0381072 8/1990 European Pat. Off. .
0503804 9/1992 European Pat. Off. .
1429932 3/1976 United Kingdom .
2136160 9/1984 United Kingdom .
2247193 2/1992 United Kingdom .
WO91/03320 3/1991 WIPO .

*Primary Examiner*—Robert G. Nilson
*Attorney, Agent, or Firm*—MacMillan, Sobanski & Todd

[57] ABSTRACT

A feedback air pressure sensing system is described, for use with spray guns, comprising an air pressure feedback line (1), an air regulator (2) with an air cap (3). Air is supplied from air line (4) via regulator (2) to a dual air-feedback valve (5) operated by trigger (6). Air continues along line (7) to spreader control valve (8) supplying fan air to spray gun cap (3). Air is also fed via line (9) to supply atomising air to air cap (3). The regulator (2) comprises a body (13), an inlet (16) for a main air supply to first (14) and second (15) air chambers, an inlet for feedback air to a third air chamber (26), a diaphragm (19) between outlet chamber (25) and a pilot chamber (27), the diaphragm (19) being supported in the regulator body (13) by a spring-loaded valve (18), and spring loaded adjustment means (24).

10 Claims, 3 Drawing Sheets

FEEDBACK AIR PRESSURE SENSING SYSTEM

This invention relates to a feedback air pressure sensing system and more particularly to spray guns in which the spray of atomised fluid can be controlled to produce a fan to round spray pattern.

As a result of increased regulations to control the emission of fluids, e.g. paint from spray guns into the atmosphere there is a need to control the pressure of the air flow in the spray gun's air cap to a maximum of 10 psi (0.7 bar). All known spray guns do not provide for an automatic control of this pressure e.g. when changing the gun's set-up from one spray pattern to another.

To ensure the correct pressure of 10 psi (0.7 bar) at the air cap the operator currently checks the pressure in the air cap by either direct measurement using a test cap, or by tabulations which indicate that the pressure reading on the main air pressure supply gauge will provide a pressure of 10 psi (0.7 bar) at the air cap.

Many conventional air supply systems to spray guns have the disadvantage that they cannot maintain 10 psi (0.7 bar) at the air cap during the change of the spray pattern setting between a fan shaped and a round shaped spray. Control of the pressure is at present made by balancing orifices requiring special baffles or bodies for each air cap and the fluid tip set-up used. In such an arrangement the input pressure has no obvious relationship with the output pressure.

An aim of the present invention is to provide a feedback air pressure sensing system with an automatic regulator for controlling the output pressure to overcome the above mentioned disadvantage.

According to the present invention there is provided a feedback air pressure sensing system comprising an air supply and an air outlet, the air supply being monitored by an air pressure feedback circuit which connects the air outlet with a regulator so that any change in pressure at the air outlet is sensed and fed back to the regulator to increase or decrease the air supply to maintain the air pressure at the air outlet at a predetermined pressure, characterised in that the regulator comprises a body, an inlet for a main air supply to first and second air chambers, an inlet for a feedback air supply to a feedback chamber, a first diaphragm between an outlet chamber and a pilot chamber, the first diaphragm being supported in the regulator body and connected to a main spring loaded valve to control the flow of air from the first chamber to the outlet chamber, a second diaphragm between the feedback chamber and a spring loaded adjustment means and a feedback valve and feedback relief stem associated with the second air chamber and the second diaphragm to control the pressure in the pilot chamber, so that adjustment of the adjustment means controls the main air pressure entering the outlet chamber to a predetermined sensed pressure at the air outlet.

Conveniently, the air pressure feedback circuit is fed from the atomising outlet of the spray gun air cap via a trigger-operated air valve/feedback valve to a feedback regulator.

The air regulator is preferably connected with a pressure guage in the feedback section to indicate the pressure at the air outlet.

An embodiment of a feedback air pressure sensing system, according to the present invention, for use with a spraygun will now be described, byway of example only, with reference to the accompanying diagrammatic drawings, in which.

Figure 1:
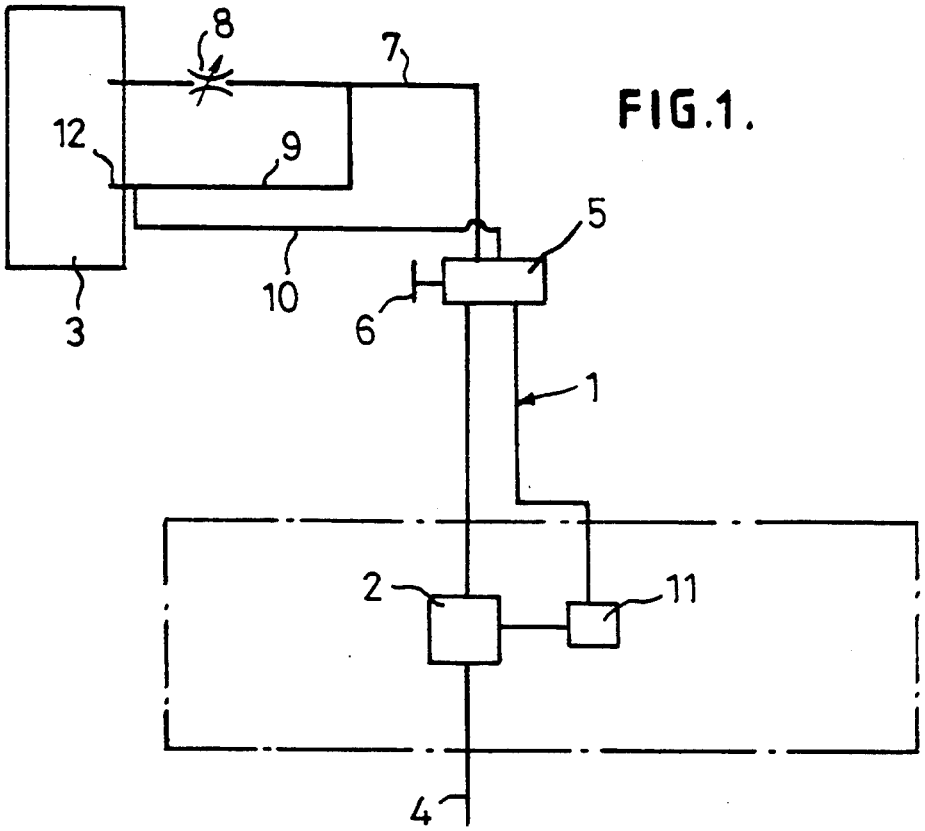
FIG. 1 is a diagrammatic view of a feedback air pressure sensing system according to the invention.

Referring to FIG. 1, the spray gun incorporates an air pressure feedback line 1 which enables a main air regulator 2, which is normally mounted at a distance from the spray gun, to sense the spraying, i.e. the atomising pressure, within an air cap 3 of the spray gun.

Air is supplied from an air line 4 via the main air regulator 2 to a dual air valve/feedback valve 5 operated by a trigger 6. The air continues along line 7 to a spreader control valve 8 to supply fan air to the spray gun air cap 3. The air is also fed via a line 9 to supply atomising air to the air cap.

Air pressure sensed in the atomising air outlet 12 of the air cap 3 is fed back to the regulator along a feedback line 10 via the dual air valve/feedback valve 5 and a time delay valve 11.

Fluid, e.g. paint to be sprayed, is fed from a fluid reservoir to the spray gun nozzle, either by pressure, suction, or gravity means (not shown).

When the gun is spraying, the atomised pressure within the air cap 3 is transmitted via the feedback circuit 1 to the main air regulator 2, via the trigger operated valve 5 and line 1.

Variations in the pressure within the feedback circuit 1 cause the main air regulator 2 to automatically readjust the air pressure to the inlet of the spray gun in order to maintain a constant atomising pressure within the air cap 3. A pressure gauge mounted in the feedback section of the main air regulator 2 will indicate the atomising pressure within the air cap 3.

Figure 3:
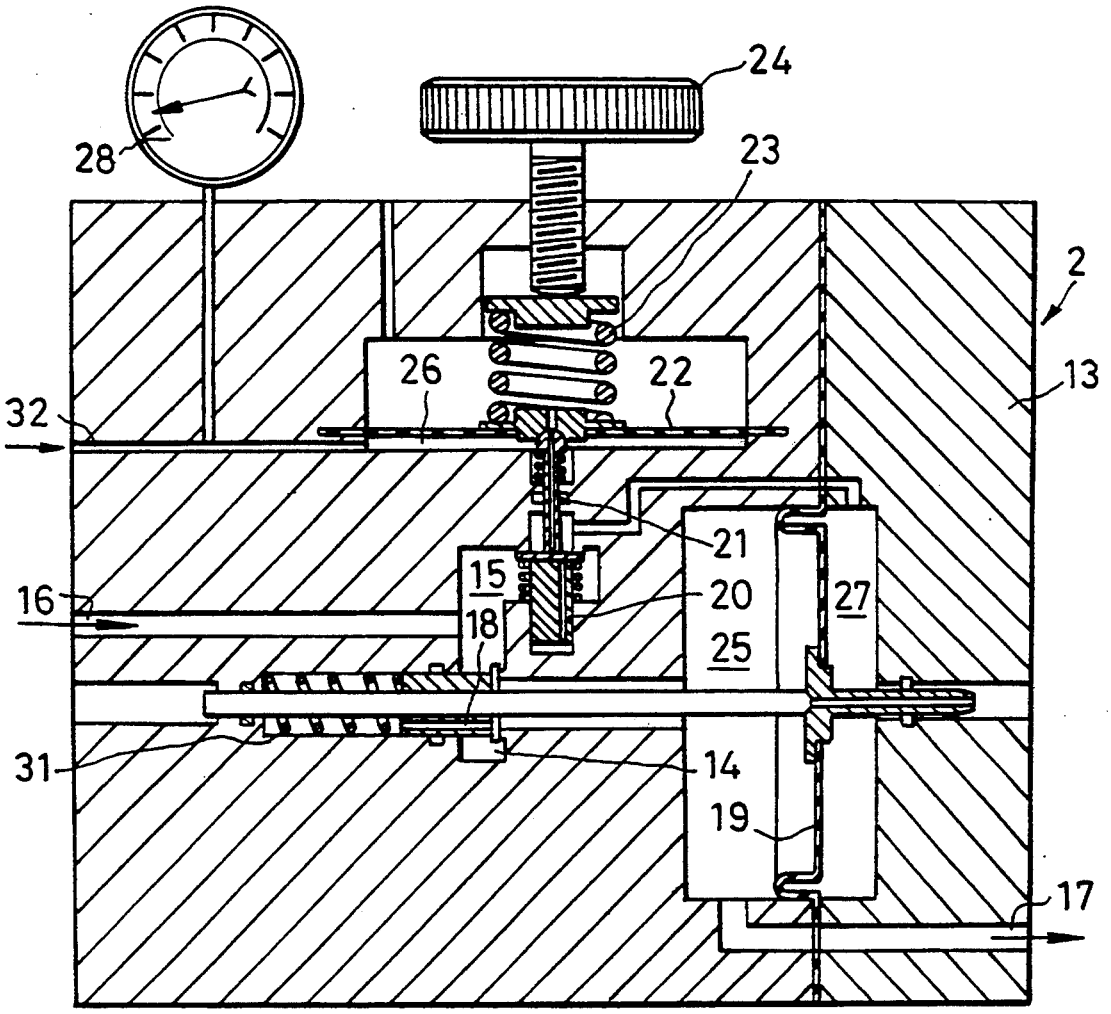
FIG. 3 is a diagrammatic cross-section of a regulator.
Figure 4:
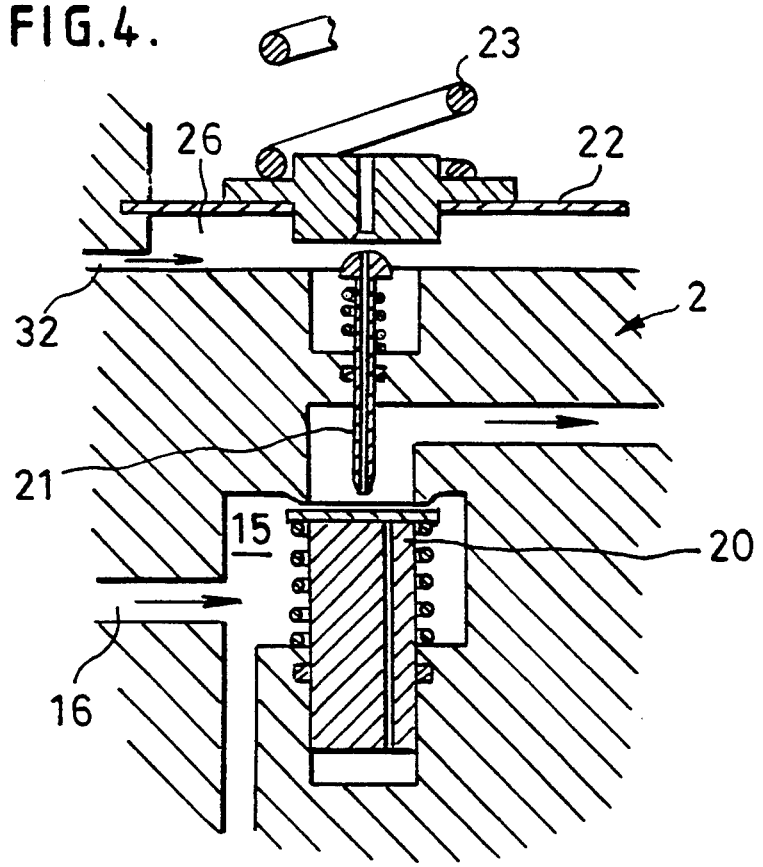
FIGS. 4 and 5 are enlarged diagrammatic cross-sectional details of the regulator shown in FIG. 3, with some separation between components for added clarity.
Figure 5:
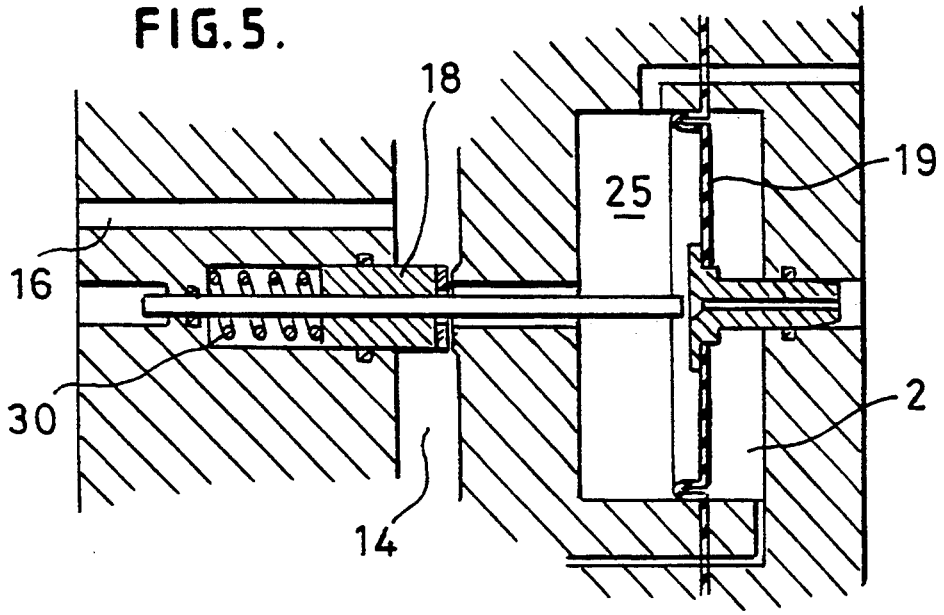

As shown in FIG. 3 the feedback regulator 2 comprises a body 13 having first and second air chambers 14 and 15 for a main air supply entering the regulator at 16. The flow of air leaving the regulator at 17 is controlled by a main valve 18, the position of which is determined by the pressure balance across a main diaphragm 19. This pressure balance is maintained by a feedback valve 20 and a feedback relief stem 21 and these valves are opened and closed by the force balance across a feedback diaphragm 22, which is in turn determined by the spring force in spring 23 set by adjustment of screw 24.

Under normal set-up conditions the feedback pressure is taken from an outlet chamber 25 and connected directly to feedback inlet 32. In this case any variation in the outlet pressure is sensed in a feedback chamber 26 via inlet 32 under the feedback diaphragm 22 and the deflection of the diaphragm opens either the feedback valve 20 or the feedback relief stem 21. The pressure fed through to the pilot chamber 27 controls the position of the main valve 18. The feedback pressure can be read from a pressure gauge 28 connected to the feedback chamber 26.

Equilibrium is restored when the outlet pressure returns to the set value that balances a control spring 23. At this point, both the feedback valve 20 and the feedback relief stem 21 are shut-off to maintain a constant outlet pressure at 17.

In a modified construction of the feedback regulator, instead of taking the feedback pressure from the outlet chamber 25 it is possible to use another source downstream of the outlet 17. In this case the regulator acts to maintain the downstream air pressure at the predetermined set pressure while the regulator outlet pressure is allowed to vary, which variation compensates for any pressure drop dependent on flowrate, such as may be caused by frictional losses in hoses or head losses across restictors between the regulator outlet 17 and the feedback source.

Under stable operation the air pressure sensed at the spray gun outlet is returned to the feedback inlet 32 and the screw 24 is adjusted to set the required operating pressure on gauge 28. If the pressure returned via the inlet 32 balances the spring force in spring 23 across the feedback diaphragm then the valves 20 and 21 remain closed.

If the pressure sensed at the spraygun outlet is higher than that which balances diaphragm 22 then the following sequence takes place:

a) the feedback to inlet 32 raises the diaphragm 22;
b) valve stem 21 is caused to lift off from its valve seat in valve 20 allowing excess air pressure to escape to atmosphere;
c) the resulting reduction in pressure in chamber 27 causes diaphragm 19 to lift under the action of spring 31 and to throttle valve 18 thus reducing the main air outlet pressure;
d) this reduced pressure is sensed by the spraygun and the new pressure is fed via inlet 32 to diaphragm 22 restoring stable operation.

In the case where the pressure sensed is lower than that which balances diaphragm 22 the following sequence takes place:

a) feedback to inlet 32 causes diaphragm 22 to be depressed under the action of spring 23;
b) valve stem 21 is depressed against valve 20 which opens allowing air from the main air supply to pass and depress diaphragm 19 thus opening valve 18 and raising the pressure of the outlet air;
c) this raised pressure is sensed at the spraygun outlet and the new pressure is fed by inlet 32 to diaphragm 22 restoring stable operation.

The air regulator 2 is initially set manually, while the gun is spraying, to give the required level of atomising pressure, typically 10 psi (0.7 bar). With the gun spraying, adjustment of the spreader control valve 8 to change the shape of the spray pattern from a fan shape to a round shape reduces the air flow through the spray gun.

Normally this reduction in air flow would result in an increase in the atomising pressure within the air cap 3 but the feedback circuit 1 prevents this by sensing the change in pressure and transmitting it to the main air regulator 2 which automatically reduces the air pressure to the spray gun, in order to maintain the atomising pressure at its pre-set level i.e. 10 psi (0.7 bar) maximum.

Readjustment of the spreader control valve 8 to change the pattern shape from a round shape back to a fan spray automatically results in the main air regulator 2 increasing the air pressure to the spray gun inlet to maintain the atomising pressure at a constant level.

Figure 2:
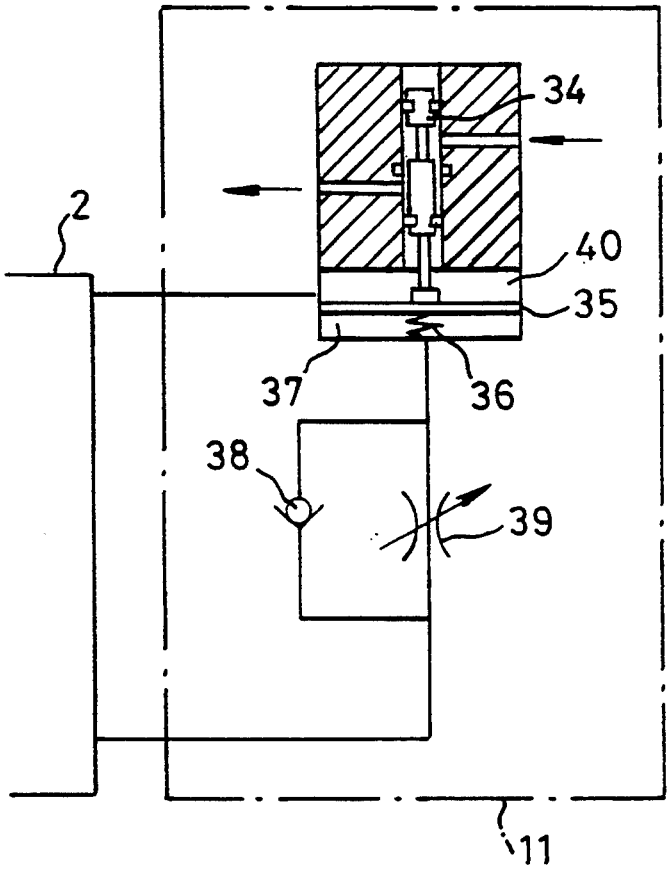
FIG. 2 is a detail diagrammatic view of a time delay valve.

Referring to FIG. 1, if the dual air valve feedback valve 5 is operated rapidly by the trigger 6, a transient pressure signal could be trapped inside the feedback line 1 and the outlet pressure of the regulator would be disturbed. To prevent this the time delay valve 11 can be fitted. As shown in FIG. 2, the time delay valve may comprise an ON/OFF spool valve 34 connected to the main air regulator 2. The spool valve 34 is actuated by a pressure difference across diaphragm 35 that is loaded by a spring 36. The high pressure side 40 of the diaphragm 35 is connected to the main outlet chamber 25 of the regulator 2 and the low pressure side 37 is connected via a non-return valve 38 and a needle valve 39 to a tapping in outlet port 17 of the regulator. When air flows through the regulator there is a pressure drop between the outlet chamber and the outlet port which operates the spool valve 34 after a certain time delay set by the setting of the needle valve 39.

The time delay prevents any transient pressure signal from reaching the regulator and disturbing the outlet pressure. The valve only transmits steady-state signals.

The feedback circuit shown in FIG. 1 therefore enables the atomising pressure within the air cap 3 of the spray gun, once set initially to 10 psi (0.7 bar), to be maintained at a constant level regardless of any adjustment to the pattern of the spray during spraying.

The regulator diaphragms may be made of rubber fabric reinforced rubber or plastics material.

Although the principle is described in the feedback regulator circuit to control the atomising air pressure in an air spray gun which is constructed and connected to an air supply in such a way that the air pressure in the air cap of the spraygun is sensed and the sensed pressure is fed back to the regulator mounted, e.g., on a wall, it may also be used in other air powered tools requiring a predetermined air supply.

I claim:

1. For a spray gun having an air cap, a feedback air pressure regulating system comprising an air supply, an air outlet at said air cap, the air supply being monitored by an air pressure feedback circuit which connects the air outlet with a regulator so that any change in pressure at the air outlet is sensed and fed back to the regulator to increase or decrease the air supply to maintain the air pressure at the air outlet at a predetermined pressure, said regulator comprising a body, an inlet for a main air supply to first and second air chambers, an inlet for a feedback air supply to a third air chamber (26), a first diaphragm between an outlet chamber and a pilot air chamber (27), said first diaphragm operating a spring loaded main valve to control the flow of air from said first air chamber to said outlet chamber, a second diaphragm between the third air chamber (26) and a spring loaded adjustment means, a pilot air valve responsive to the position of said second diaphragm and connected between said second chamber and said pilot air chamber to control the flow of air from said second chamber to said pilot air chamber and to control the venting of air from said pilot air chamber whereby adjustment of the adjustment means controls the pilot air pressure in said pilot air chamber to regulate the main air pressure entering the regulator inlet to a predetermined pressure at the air outlet.

2. For a spray gun having an air cap, a feedback air pressure regulating system as claimed in claim 1, characterised in that the regulator includes a pressure gauge connected to a feedback chamber to indicate the feedback pressure fed back to the regulator from the air outlet.

3. For a spray gun having an air cap, a feedback air pressure regulating system as claimed in claim 2, characterised in that the regulator diaphragms are made of rubber, or fabric reinforced rubber.

4. For a spray gun having an air cap, a feedback air pressure regulating system as claimed in claim 2, characterised in that the regulator diaphragms are made of a resilient plastics material.

5. For a spray gun having an air cap, a feedback air pressure regulating system as claimed in claim 1, characterised in that the air pressure feedback circuit connects an atomising air outlet of the air cap to said feedback regulator via a trigger-operated air valve/feedback valve.

6. For a spray gun having an air cap, a feedback air pressure regulating system as claimed in any preceding claim, characterised in that a time delay valve is located in a feedback line between an outlet chamber and said feedback air regulator valve.

7. For a spray gun having an air cap, a feedback air pressure regulating system as claimed in claim 6, characterised in that the time delay valve is a spool valve operated by a second spring loaded diaphragm, characterised in that one side of said second spring loaded diaphragm is connected via a non-return valve and an adjustable needle valve with the outlet port of the feedback regulator and the other side of the diaphragm is connected to the outlet chamber of the regulator.

8. For a spray gun having an air cap, a feedback air pressure regulating system as claimed in claim 1, and wherein said pilot air valve has first, second and third operating modes determined by the position of said second diaphragm, said pilot air valve connecting said pilot air chamber to said second chamber when in said first mode, closing said pilot air chamber when in said second mode and venting said pilot air chamber when in said third mode.

9. Apparatus for supplying predetermined low pressure atomization air and pattern shaping air to a spray gun air cap comprising a normally closed trigger valve having a main air inlet port connected to a main air outlet port when said valve is triggered and having a feedback air inlet port connected to a feedback air outlet port when said valve is triggered, means for delivering air from said main air outlet to said air cap, means for returning a sample of such delivered air to said feedback air inlet, a source of pressurized air at a pressure above said predetermined low pressure, a pressure regulator having a main air inlet connected to said pressurized air source and an air outlet connected to said trigger valve main air inlet port, means for supplying feedback air from said trigger valve feedback air outlet port to said regulator, said regulator regulating the pressure of air delivered from said supplying means to said air cap in response to the pressure of such air sample.

10. Apparatus for supplying predetermined low pressure atomization air and pattern shaping air to a spray gun air cap, as set forth in claim 9, and including a time delay valve means located in said feedback air supplying means, said time delay valve delaying the response of said regulator to any sudden changes in the air sample.

* * * * *